US005855235A

United States Patent [19]

Colson et al.

[11] Patent Number: 5,855,235

[45] **Date of Patent: *Jan. 5, 1999**

[54] RETRACTABLE WINDOW COVERING

[75] Inventors: Wendell B. Colson, Boulder; Terry Lee Akins, Louisville, both of Colo.

[73] Assignee: Hunter Douglas Inc., Upper Saddle River, N.J.

[ * ] Notice: The term of this patent shall not extend beyond the expiration date of Pat. No. 5,320,154.

[21] Appl. No.: 198,317

[22] Filed: Feb. 18, 1994

Related U.S. Application Data

[63] Continuation of Ser. No. 717,284, Jun. 20, 1991, Pat. No. 5,320,154, which is a continuation-in-part of Ser. No. 626, 916, Dec. 13, 1990, abandoned.

[51] Int. Cl.[6] ..... E06B 9/08

[52] U.S. Cl. ..... 160/121.1; 160/23.1; 160/291; 160/300; 160/303; 160/349.1; 160/392; 160/395

[58] Field of Search ..... 160/121.1, 23.1, 160/133, 291, 300, 303, 392, 395, 349.1

[56] References Cited

U.S. PATENT DOCUMENTS

| | | | |
|---|---|---|---|
| Re. 30,254 | 4/1980 | Rasmussen . | |
| 286,027 | 10/1883 | Lobdell | 160/392 |
| 1,937,342 | 11/1933 | Higbie . | |
| 1,958,695 | 5/1934 | Claus | 160/231 |
| 2,029,675 | 2/1936 | Schlamp . | |
| 2,110,145 | 3/1938 | Loehr . | |
| 2,140,049 | 12/1938 | Grauel | 160/121.1 |
| 2,267,869 | 12/1941 | Loehr . | |
| 2,834,412 | 5/1958 | Velke | 160/395 |
| 2,865,446 | 12/1958 | Cole . | |
| 2,914,122 | 11/1959 | Pinto . | |
| 3,292,685 | 12/1966 | Clark . | |
| 3,371,702 | 3/1968 | Keegan et al. | 160/395 X |
| 3,384,519 | 5/1968 | Froget . | |
| 3,421,276 | 1/1969 | La Barge | 160/395 X |
| 3,661,665 | 5/1972 | Froget . | |
| 3,701,376 | 10/1972 | Froget | 160/121 |
| 3,783,931 | 1/1974 | Assael | 160/395 X |
| 4,019,554 | 4/1977 | Rasmussen . | |
| 4,039,019 | 8/1977 | Hopper . | |
| 4,182,088 | 1/1980 | Ball | 160/395 X |
| 4,194,550 | 3/1980 | Hopper . | |
| 4,344,474 | 8/1982 | Berman | 160/121.1 |
| 4,386,454 | 6/1983 | Chodosh . | |
| 4,519,434 | 5/1985 | Forquer | 160/133 |
| 4,694,543 | 9/1987 | Conley | 160/395 X |

FOREIGN PATENT DOCUMENTS

| | | |
|---|---|---|
| 249985 | 3/1964 | Australia . |
| 29442 | 11/1972 | European Pat. Off. . |
| 430882A1 | 6/1991 | European Pat. Off. . |
| 319458 | 3/1902 | France . |
| 847779 | 10/1939 | France . |
| 1166398 | 11/1958 | France . |
| 1309194 | 10/1962 | France . |
| 1321456 | 2/1963 | France . |
| 1364674 | 12/1963 | France . |
| 1373515 | 8/1964 | France . |
| 1381472 | 11/1964 | France . |
| 1480262 | 7/1966 | France . |
| 1465261 | 1/1967 | France . |
| 1585159 | 1/1968 | France . |
| 1526507 | 5/1968 | France . |
| 2217518 | 9/1974 | France . |
| 2398170 | 2/1979 | France . |

(List continued on next page.)

*Primary Examiner*—Derek J. Berger
*Attorney, Agent, or Firm*—Dorsey & Whitney LLP

[57] ABSTRACT

A retractable window covering panel including spaced apart parallel sheets of flexible fabric with vanes adhesively secured therebetween. The covering includes a roller or head rail with a wrinkle and buckle compensating structure such as longitudinal lobes or ribs to prevent creasing, wrinkling, or buckling of the window covering when rolled up. The head rail has means for attaching the window covering to insure proper alignment of the window covering. A bottom rail is secured to one or both sheets. An anti-skew device is provided.

25 Claims, 12 Drawing Sheets

U.S. PATENT DOCUMENTS

| | | | |
|---|---|---|---|
| 4,799,299 | 1/1989 | Campbell | 160/395 X |
| 4,912,900 | 4/1990 | Yeamans | 160/395 X |
| 5,117,893 | 6/1992 | Morrison et al. | 160/291 |
| 5,320,154 | 6/1994 | Colson et al. | 160/121.1 |

FOREIGN PATENT DOCUMENTS

| | | |
|---|---|---|
| 122088 | 4/1900 | Germany . |
| 382758 | 10/1923 | Germany . |
| 684202 | 11/1939 | Germany . |
| 1241361 | 5/1967 | Germany . |
| 7008554 | 3/1970 | Germany . |
| 1942674 | 10/1971 | Germany . |
| 2304809 | 8/1974 | Germany . |
| 2735654 | 4/1978 | Germany . |
| 2923233 | 11/1980 | Germany . |
| 2936811 | 4/1981 | Germany . |
| 3525515 | 1/1987 | Germany . |
| 8810922 | 12/1988 | Germany . |
| 8906284 | 9/1989 | Germany . |
| 7805464 | 10/1979 | Netherlands . |
| 331432 | 7/1958 | Switzerland . |
| 423207 | 4/1967 | Switzerland . |
| 476482 | 11/1969 | Switzerland . |
| 494338 | 4/1970 | Switzerland . |
| 979683 | 1/1965 | United Kingdom . |
| 1228677 | 4/1971 | United Kingdom . |
| 8002712 | 12/1980 | WIPO . |

RETRACTABLE WINDOW COVERING

CROSS-REFERENCE TO RELATED APPLICATION

This application is a continuation of application Ser. No. 07/717,284, filed Jun. 20, 1991 now U.S. Pat. No. 5,320,154, which application is a continuation-in-part of application Ser. No. 07/626,916, filed Dec. 13, 1990, now abandoned.

BACKGROUND OF THE INVENTION

1. Field of the Invention

The present invention relates to retractable panels and covering devices finding particular but not exclusive utility for covering various architectural openings such as windows, and as retractable space dividers. More specifically, the present invention relates to roller type mounting and deployment of light control window coverings having first and second parallel sheets and a plurality of transverse vanes connecting said sheets.

2. Description of the Prior Art

Fabric light control window coverings are known in the art, as shown in U.S. Pat. No. 3,384,519 to Froget. This patent discloses a window shade having two parallel mesh fabric sheets with a number of movable vanes disposed between the sheets. The parallel fabric sheets are movable relative to each other in order to control the angle of the vanes or blades. This shade is attached to a typical cylindrical roller shade head roller for rolling up the shade and controlling the angle of the blades. Similar disclosures are found in U.S. Pat. No. 2,029,675, U.S. Pat. No. 2,140,049, and French Pat. No. 1,309,194. German Pat. No. 382,758 discloses a similar window covering; however, instead of a cylindrical head roller, an elliptical head roller is provided.

As illustrated in the above disclosures, such a window covering is generally a sandwich of three layers which are attached together at various points. As the sandwich rolls around a roller, the layer around the outside must travel a greater distance than the inner layer, thereby compressing and wrinkling the layers. The thicker the sandwich is, and particularly the thicker the blades, the more pronounced this effect becomes. Thus, in practice with known deployment means, as the window covering rolls up around the head roller, the outer layer must stretch or the inner layer must buckle in order to accommodate the different distances that the two layers follow around the roller. Stretchy fabrics are undesirable because the blades would be unaligned in the lowered position and if non-stretchy fabrics are used the inner layer buckles. Such buckles can cause a permanent wrinkle or crease to develop in the fabric over time. This is because as the window covering is wrapped tightly around the roller there is a constant pressure compressing the buckle in the inner layer between the other layers and against the roller itself. In addition to an unattractive appearance, the buckles also create a high point on the roller which can occur unevenly and cause the window covering to roll up unevenly or skew to one side of the roller.

U.S. Pat. No. 4,344,474 to Berman discloses an insulated shade which includes a number of layers wrapped around a cylindrical head roller. While not a light control shade, the layers of the Berman shade appear to be connected together by bushings. Berman has recognized that the different layers will roll up at different rates and has provided journal plates having slotted holes to retain the bushings. This allows relative sliding between the bushings in an attempt to compensate for the different roll up rates of the different layers.

In roller shades in general it is important that the fabric be fastened to the head roller at an exact right angle to the cut edges of the fabric. This is to insure that the fabric rolls up straight along the head roller without skewing to the left or right. The curtain roller disclosed in U.S. Pat. No. 285,027 to Lobdell is an attempt to solve this problem in typical single sheet roller shades. Two slats are provided, one having tacks extending outward therefrom. The slot with tacks is positioned at the top of the curtain, at a right angle to the longitudinal line of direction of the curtain. The tacks are pressed through the curtain fabric and the second slat is pressed on to the tacks on the opposite side of the curtain. The slats attached to the curtain are slid into a complimentary groove in the roller. This construction has disadvantages in not being self aligning and requiring that the slats be placed very exactly on the curtain fabric.

OBJECTS AND SUMMARY OF THE INVENTION

It is the principal object of the present invention to provide an improved structure for rolling and unrolling a layered light control covering device, which does not create permanent creases or wrinkles in the layers.

Another object is to provide an improved window covering which allows for rolling without skewing of the covering device to the left or right.

Still another object of the present invention is to provide an improved structure for attaching a covering device to a head roller which ensures alignment of the covering device with the head roller.

These and other objections of the invention will be realized by the present invention which generally includes a roller means for rolling and unrolling the window covering without creating wrinkles or creases.

In accordance with the foregoing objects, the present invention is embodied in a roller having a discontinuous surface formed by outwardly extending lobes or rounded projections which define recesses to receive buckles formed in the inner layer of the covering device as it is rolled on to the roller. Thus, the buckles are not pressed against the roller to form permanent creases or wrinkles. Also the buckles do not create high spots which would cause the covering device to skew to the left or right when rolled onto the roller. In this regard, a further feature of the present invention is a bottom rail with a slidable weight which may be selectively transversely positioned to compensate for inconsistencies in manufacture and mounting which lead to skewing.

The present invention further provides a recess in the roller parallel to the roller axis for attaching a vaned covering device to the roller. The line of attachment between the top vane and one sheer fabric is received in the recess and held in place by a holding means. Because all vanes are parallel to one another, they are then parallel to the roller. In one embodiment, the holding means includes a triangular channel in the head roller which receives a wedge shaped filler strip. The recess just described is formed by the vertex of the triangular channel. The wedge shape of the filler strip cooperates with one of the sheer fabrics and the top vane of the covering device to force the window covering along the line of attachment between the vane and fabric into the triangular channel, thus ensuring proper alignment. A second channel may be provided for attaching the opposite sheer fabric and is designed to tension the first vane against the wedge shaped filler strip, thus further insuring proper alignment. The second channel may be provided with a circular cross section formed in the roller means. The circular channel has an opening which is less in the inside diameter of the channel. The second sheer fabric is wrapped around a resilient tubular clamping member which is forced through the opening into the circular channel. In another embodiment, the second channel is V-shaped and the second sheer fabric is secured to a complementary V-strip and inserted in the V-shaped channel such that the second sheer fabric is firmly held between the V-shaped channel and the V-strip. In still another embodiment, the first and second sheer fabrics are attached to a roller means simultaneously by securing both the first and the second sheer fabrics to the same slat or strip and then force fitting this common slat or strip into a complementarily shaped roller means.

Additionally, an elongated member may be attached along the bottom of the covering device utilizing the triangular channel and a wedge shaped filler trip to provide a finished appearance to the shade. In a second embodiment, a bottom rail assembly having a C-shaped cross section is attached to the ends of the two sheer fabrics of the window covering to provide a different finished appearance to the shade.

BRIEF DESCRIPTION OF THE DRAWINGS

The features and advantages of the present invention will be more readily apparent from the following detailed description of the preferred embodiments, illustrated in the drawing figures wherein.

DETAILED DESCRIPTION OF THE PREFERRED EMBODIMENTS

Figure 1:
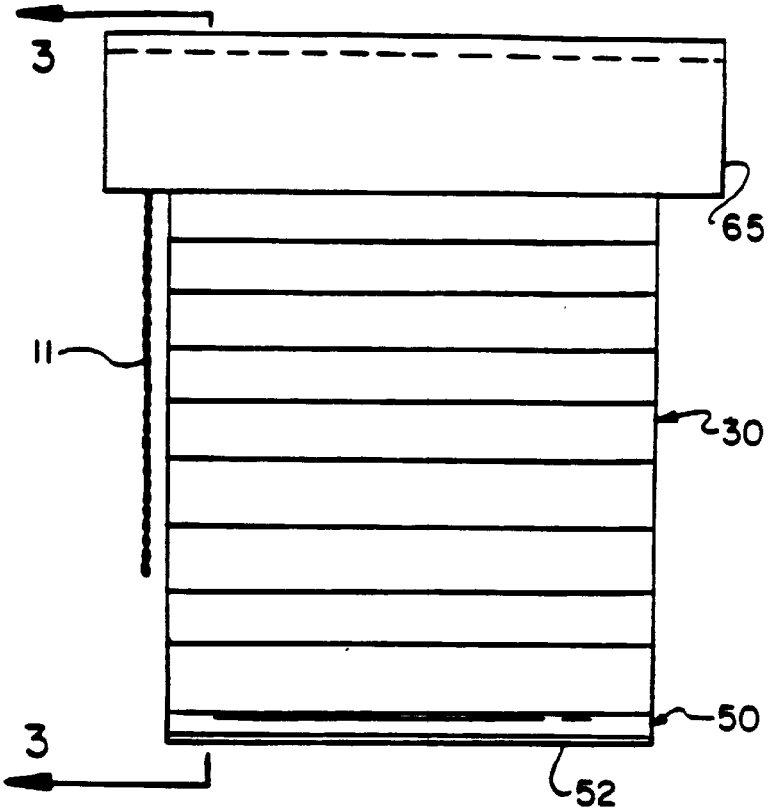
FIG. 1 is a front elevation view of a window covering according to the present invention.
Figure 2:
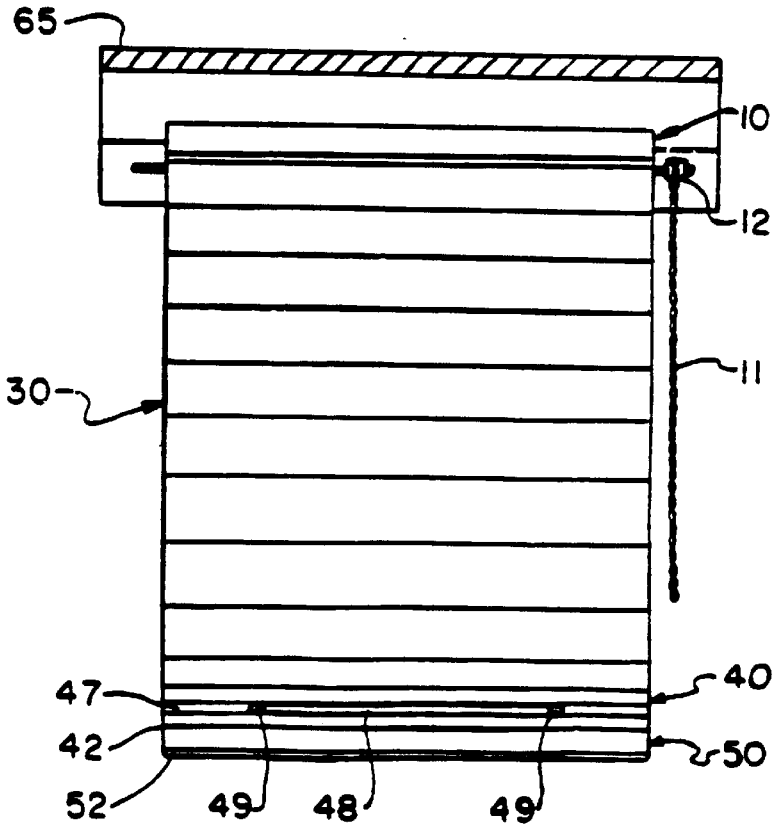
FIG. 2 is a rear elevation view of the window covering of FIG. 1.
Figure 3:
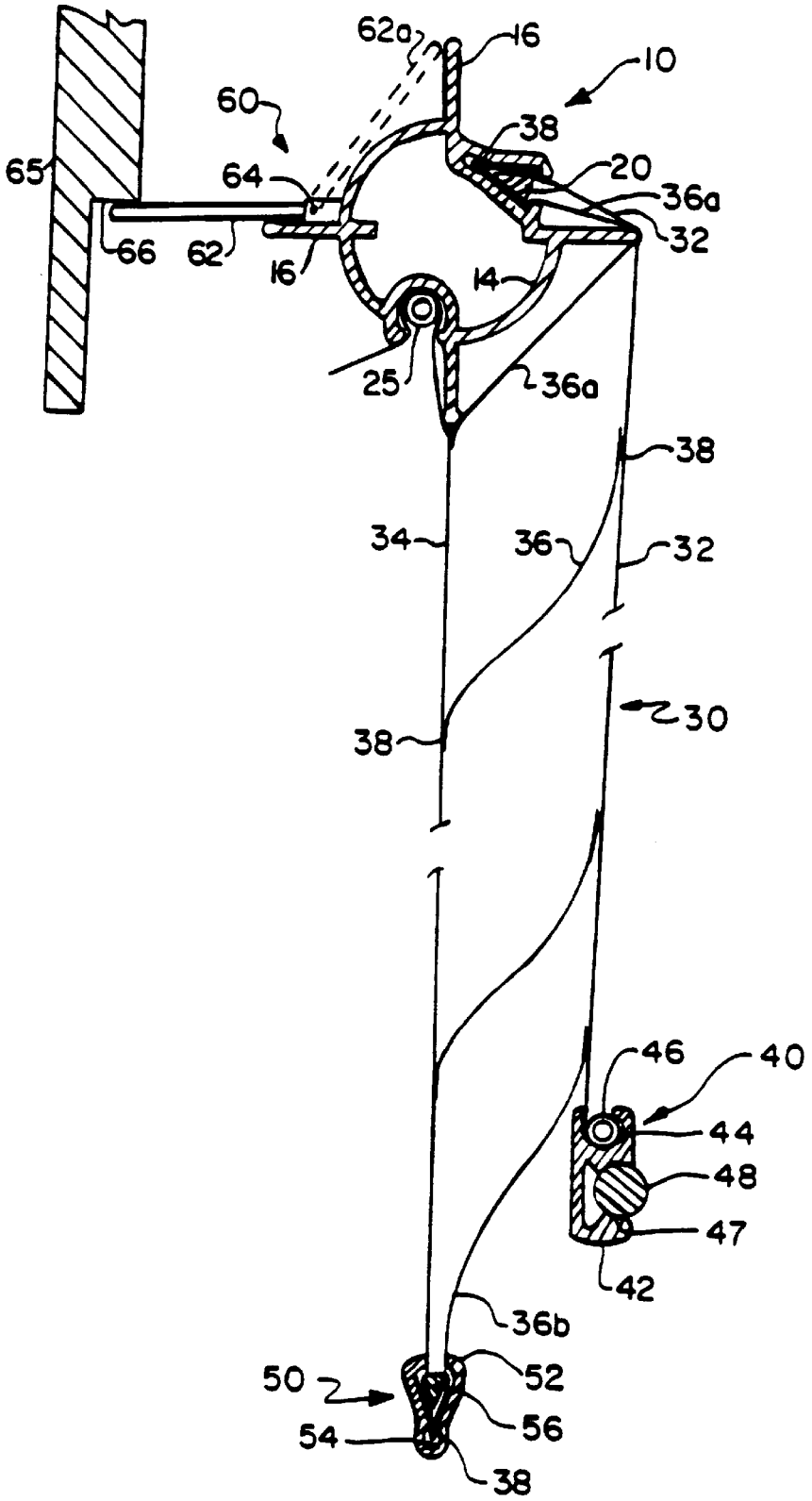
FIG. 3 is a cross-sectional view of the window covering of FIG. 1 as viewed through line 3—3 in FIG. 1.

While the description of the invention is made below with reference to window coverings, the teachings of the present invention are also applicable to devices for covering openings of all types and also for use as room dividers. Referring first to FIGS. 1 and 2, the main components of the present invention are a head roller assembly 10, a light control window covering or panel 30, a rear bottom rail assembly 40 and a front bottom rail assembly 50. Also illustrated is valance 65 which cooperates with a flip-catch mechanism 60, as shown in FIG. 3. The head roller assembly 10 is rotatably mounted and driven in a known manner by a chain or cord 11 cooperating with a wheel 12.

As shown in FIG. 3, in a preferred embodiment of the present invention, the light control window covering 30 is formed as a panel which includes first and second parallel flexible sheer fabrics 32 and 34 which are connected by a number of transverse fabric vanes 36 to form a light control element. Relative motion of first and second sheer fabrics 32 and 34 in a direction perpendicular to vanes 36 changes the angle of the vanes and thus controls the amount of light admitted through the window covering. Preferably, vanes 36 are adhesively bonded to the sheer fabrics in a manner which tends to bias first and second sheer fabrics 34 and 32 towards one another. Vanes 36 are also preferably applied with adhesive bond lines 38 exactly perpendicular to the longitudinal edges of the sheer fabrics 32, 34. It should be appreciated that the present invention relates to apparatus and methods for mounting and deploying such coverings. As such, the present invention may be used with coverings made with any flexible sheet material and flexible, strip material for the sides and vanes of the covering device. In this regard, reference to sheer fabrics and fabric vanes throughout should not be considered as limiting of the present invention.

Figure 5:
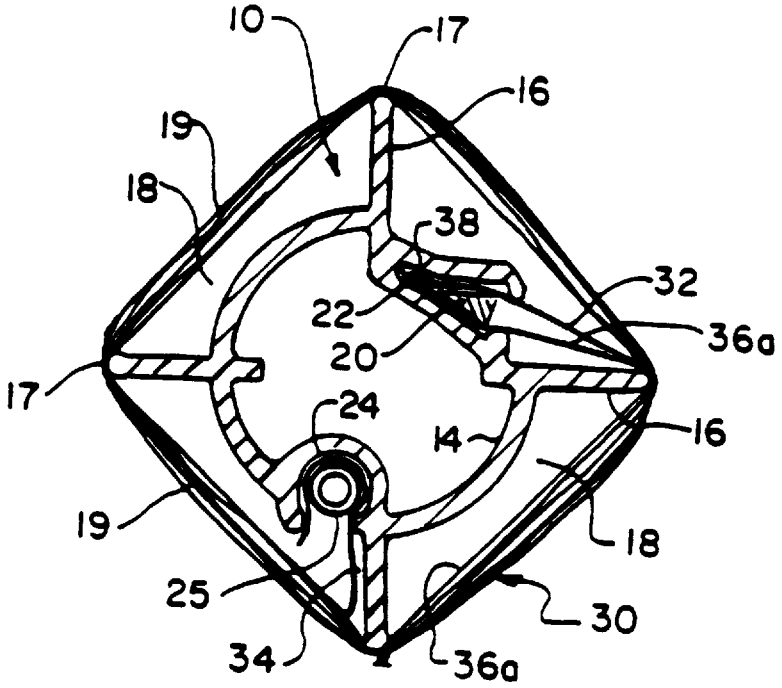
FIG. 5 is an enlarged cross-sectional view of the head roller according to the present invention illustrating the function of the lobed projections.
Figure 6:
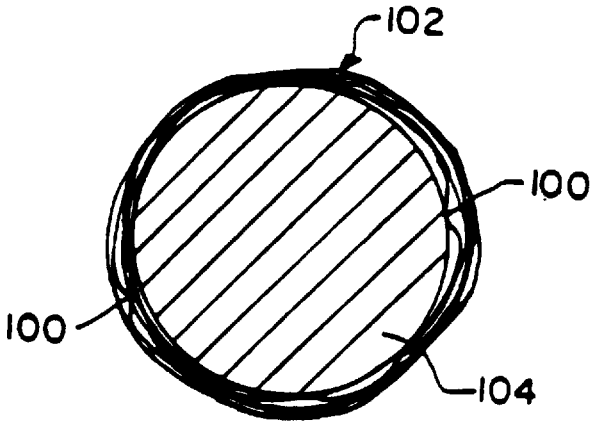
FIG. 6 PRIOR ART
FIG. 6 is a cross-sectional view of a head roller according to the prior art.

The head roller assembly 10 according to a preferred embodiment of the present invention is shown in greater detail in FIG. 5. A rigid central support member 14 is provided with a number of ribs or lobes or rounded projections 16 extending longitudinally along the roller parallel to the roller axis. In the embodiment illustrated in FIG. 5 four lobes are utilized. Depending on the size of the head roller and the characteristics of the fabric, the number of lobes may be varied in order to provide the desired function as discussed below. In particular, three lobes have also been found to work satisfactorily.

Lobes 16 allow the fabric window covering to wrap around four linear bumps or apexes 17 extending transversely across the window covering 30. The window covering wraps tightly at bumps 17 and then follows a relatively straight line to the next linear bump 17. Lobes 16 provide a discontinuous surface with recesses 18 formed between lobes 16. The window covering is thus able to wrap loosely with relatively low pressure on the layers located in recesses 18 between the lobes 16. Buckles 19, which develop between the fabric layers of window covering 30 due to the layered construction, form in the loosely wrapped straight portions between lobes 16 and are not set into the window covering by pressure against the head roller because they fall within recesses 18. Also, because the buckles 19 occur in recesses 18 and are not pressed against the roller as in the prior art, window covering 30 wraps tightly around lobes 16 and rolls up straight without skewing.

Although lobes 16 which project radially outwardly from the support member 14 are illustrated in FIG. 5, the linear bumps 17 can be provided directly on the surface of the support member. For example, the support member can be rectangular, with the four corners of the rectangular support member defining the linear bumps. The number of linear bumps is not limited to four, and support members of any regular or irregular polygonal cross section can be used provided that there is a relatively straight line path of sufficient length between adjacent linear bumps to provide an area in which the window covering is loosely wrapped and not compressed. As a practical matter, suitable polygonal support members are those having at least three and preferably no more than six sides. Support members having a modified polygonal cross section are also suitable for use in this invention. one type of preferred modified polygonal support member is one in which the sides extending between the linear bumps are curved inwardly, rather than straight, in order to provide deeper recesses for receiving the buckles formed in the loosely wrapped straight portions between the linear bumps. The support member can also have only two linear bumps or contact points for the window covering. Examples of such a structure include a substantially flat support member wherein the longitudinal edges of the support member define the linear bumps, or two spaced apart cylindrical rods of small diameter, wherein each cylindrical rod defines a linear bump and the spaces between the two cylindrical rods provides the recesses for the buckles.

As can be appreciated from the above description, numerous configurations of a support member for a head roller assembly are possible within the scope of the invention. The roller includes a plurality of means for defining apexes on an outer surface thereof. The apex defining means provide longitudinal contact points for the window covering around the roller and the apex defining means are spaced apart so as to provide a substantially straight path for the window covering from one apex defining means to an adjacent apex defining means. The important features of the support member are that it includes at least two linear bumps at which the window covering wraps tightly and then follows a relatively straight line between linear bumps to provide an area in which the window covering is not compressed. In order to prevent the buckles which form in the loosely wrapped straight portions between linear bumps from being set in the window covering, each straight line path between linear bumps should be at least one-half inch in length.

As previously discussed, it is important that the fabric of roller shades be fastened to the head roller at an exact right angle to the edges of the fabric. This is to ensure that the fabric will roll up straight along the head roller without skewing to the left or right. With fabric light control window coverings this factor is also present, however there is a second important factor. The second factor is that the position of mounting of the window covering to the head roller with respect to the individual vanes is important. If the window covering is not mounted with the correct alignment relative to the vanes, the window covering may not close all the way or may not operate correctly when fully deployed.

In the present invention the apparatus for and method of attachment of the window covering to the head roller ensures proper alignment of first and second sheer fabrics 32, 34 with respect to the head roller and also proper alignment of vanes 36 with respect to the head roller. The attachment means utilizes a wedge shaped filler strip 20 which inserts into a complementarily wedge shaped channel 22. The filler strip 20 is placed between sheer fabric 32 and top vane 36*a*. The wedge shape of the filler strip 20 centers itself against the adhesive line 38 which bonds sheer fabric 32 and top vane 36*a*. With filler strip 20 placed between sheer fabric 32 and vane 36*a*, the fabric and filler strip are inserted into channel 22 from one end of head roller assembly 10. Alternatively, the head roller may be designed to accept the filler strip by inserting it generally radially with a snap fit. As the fabric is inserted into channel 22 adhesive line 38 is forced by wedge shaped filler strip 20 into the vertex of channel 22. The vertex forms a recess parallel to the roller axis for receiving the adhesive line. This ensures the centering of the fabric construction in channel 22 along head roller central support 14 and attachment at a right angle to the head roller.

Figure 8:
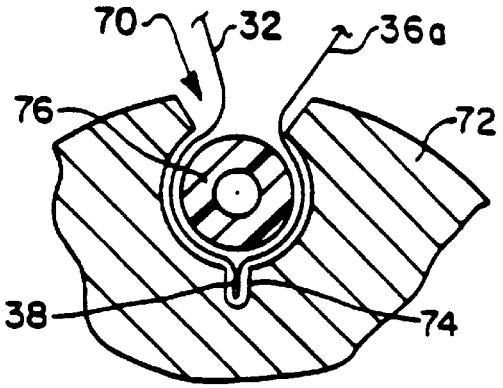
FIG. 8 is a partial cross-sectional view of an alternative attachment means according to the present invention.

In an alternative embodiment, shown in FIG. 8, a channel 70 is provided in head roller 72 with a longitudinal recess 74 parallel to the roller axis. Recess 74 is adapted to receive adhesive line 38. Insertion of filler strip 76 thus locates adhesive line 38 in longitudinal recess 76 along the length of head roller 72 to guarantee correct alignment of the window covering. Channel 70 and filler strip 76 need not be circular as shown in FIG. 8. Practically any cross-section shape will perform as desired if recess 74 is formed parallel to the roller axis and the channel and filler strip cooperate to prevent slippage of the fabric. Filler strip 76 may be resilient compressible material which is capable of insertion through the radially directed opening of channel 70, or it may be a less resilient material which is inserted into channel 70 through an opening at one end.

Second sheet fabric 34 is secured into a second, circular channel 24 (FIG. 5) by wrapping around length of compressible tubing 25 sized to be pressed into channel 24. A 3/16 inch vinyl tubing with a complementarily sized channel has been found to adequately secure the fabric. The attachment of the second sheet fabric in this manner pulls vane material 36*a* tightly across lobes 16 and thus ensures that adhesive line 38 is centered on the wedge shaped filler strip 20 to guarantee perpendicular alignment of the window covering with the head roller.

Figure 9A:
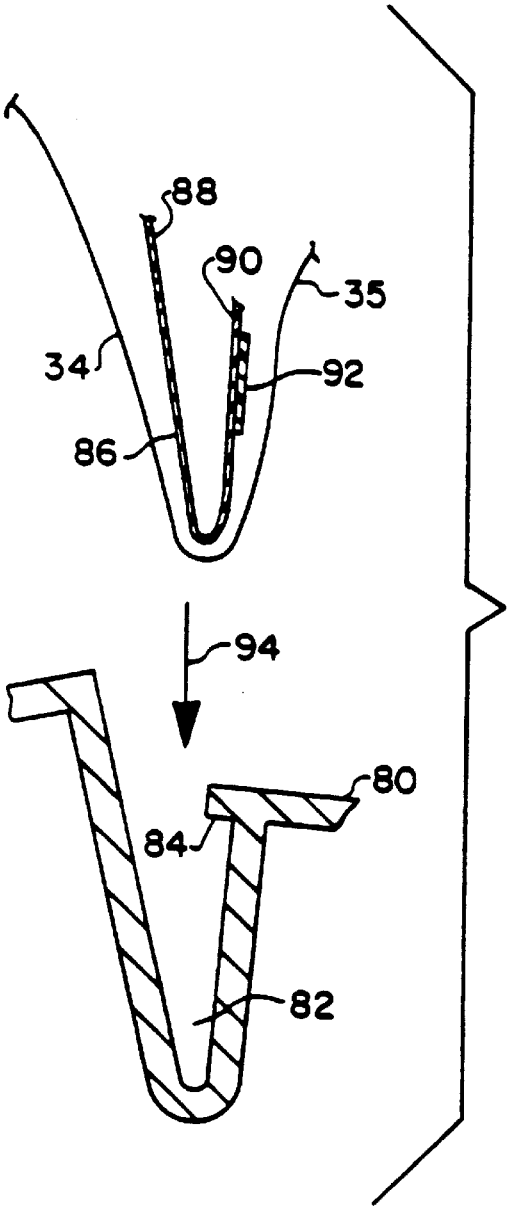
FIGS. 9*a–b* are partial cross-sectional views of a further alternative attachment means according to the present invention.
Figure 9B:
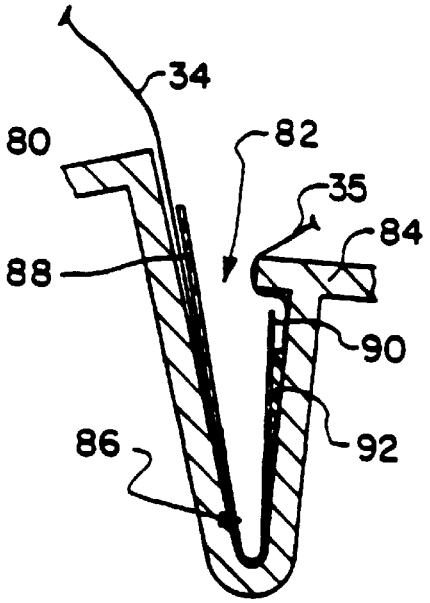

An alternative embodiment for the attachment of second sheet fabric 34 to the head roller is shown in FIGS. 9*a* and 9*b*. Head rail 80 is provided with V-shaped channel 82. One leg of V-shaped channel 82 has an inwardly projecting stop 84 and the opposite leg extends outward, beyond stop 84. V-strip 86 is provided having longer leg 88 and a shorter leg 90. Second sheer fabric 34 is passed around V-strip 86 with the cut off edge 35 of second sheer 34 positioned adjacent to and extending slightly beyond shorter leg 90. Adhesive transfer tape 92 is provided at least on shorter leg 90 to grip, at least temporarily, the fabric. With second sheer fabric 34 wrapped around V-strip 86, the V-strip is inserted into V-shaped channel 82 as indicated by arrow 94. The V-strip cooperating with the V-shaped channel, combined with the adhesive transfer, helps to ensure that the second sheer fabric is attached perpendicular to the V_shaped channel. The biasing force of V-strip 86 in channel 82 also pulls first vane 36*a* tightly across the lobes as required.

V-strip 86 is preferably made of a resilient material to allow a snap fit into channel 82. It has been found that polycarbonate or a polyester such as 10 mil MYLAR provides sufficient stiffness to hold the fabric yet retains the resiliency necessary for a snap fit.

The various attachment means are illustrated in the drawing figures with component parts spaced apart in order to clearly illustrate each layer and part. In practice, the fabric layers are tightly pressed between the adjoining parts.

When the window covering 30 is fully unrolled from head roller assembly 10, the angle of vanes 36 may be controlled by rotation of the head roller assembly. In order to provide the window covering with a crisp and taut appearance and also ensure that the vanes 36 move correctly between open and closed positions, a weighted rear bottom rail assembly 40 is provided. The rear bottom rail assembly also provides an anti-skew device which is useful not only with fabric light control window coverings, but with any type or roller shade.

Even with the lobed head rail as discussed above, slight inconsistencies in manufacture, or mounting of the head roller slightly off of the horizontal line can cause the window covering to skew to the left or right when rolled up. The anti-skew device of the present invention provides a novel method and apparatus for compensating for such inconsistencies in manufacture or mounting. Rear bottom rail assembly 40 (FIG. 3) includes a rigid member 42 which may be provided with a circular channel 44 and compressible tubing 46 for attachment of sheer fabric 32 in the same manner as sheer fabric 34 is attached to head roller assembly 10. Preferably, however, attachment means such as shown in FIGS. 9*a* and 9*b*, including V-shaped channel 82 and V-strip 86, is utilized for the rear bottom rail assembly.

Rigid member 42 is also provided with channel 47 which slidingly receives weight 48. The position of weight 48 along channel 47 may be fixed by retainer clips 49 (shown in FIG. 2) which may be squeezed to slide in channel 47 and released to grip the channel. If, for example, the window covering was skewing to the right as it was rolled up, this could be corrected by sliding weight 48 to the right. This creates a greater tension on the right hand side of the window covering, causing the window covering to be rolled tighter around the head rail on that side and thus have a smaller diameter which will cause the shade to begin to skew to the left. Weight 48 may be moved back and forth until the window covering rolls up straight without left or right skewing.

Front bottom rail assembly 50 is essentially a decorative finish for the bottom front of the window covering. Rigid member 52 is provided with a channel 54 which receives wedge shaped filler strip 56. Wedge filler strip 56 is placed between vane 36*b* and second fabric 34 to secure bottom rail assembly 50 to the window covering in the same manner as first fabric 32 and vane 36*a* are secured to the head roller. Wedge shaped filler strip 56 ensures that the front bottom rail assembly 50 is parallel to vanes 36 and perpendicular to the first and second sheer fabric edges. Alternatively, the embodiment shown in Fib. 8 may be utilized. In a further alternative embodiment, the front and rear bottom rails may be combined into a single bottom rail.

Figure 10:
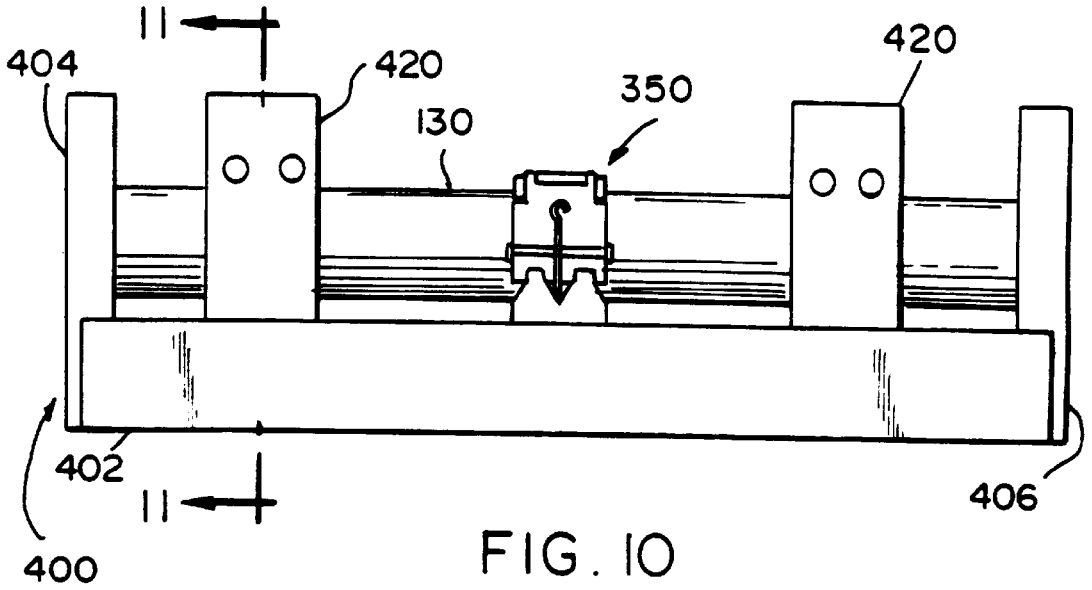
FIG. 10 is a top view of another embodiment of a window covering of the present invention, including means for mounting the window covering on a wall or ceiling.
Figure 11:
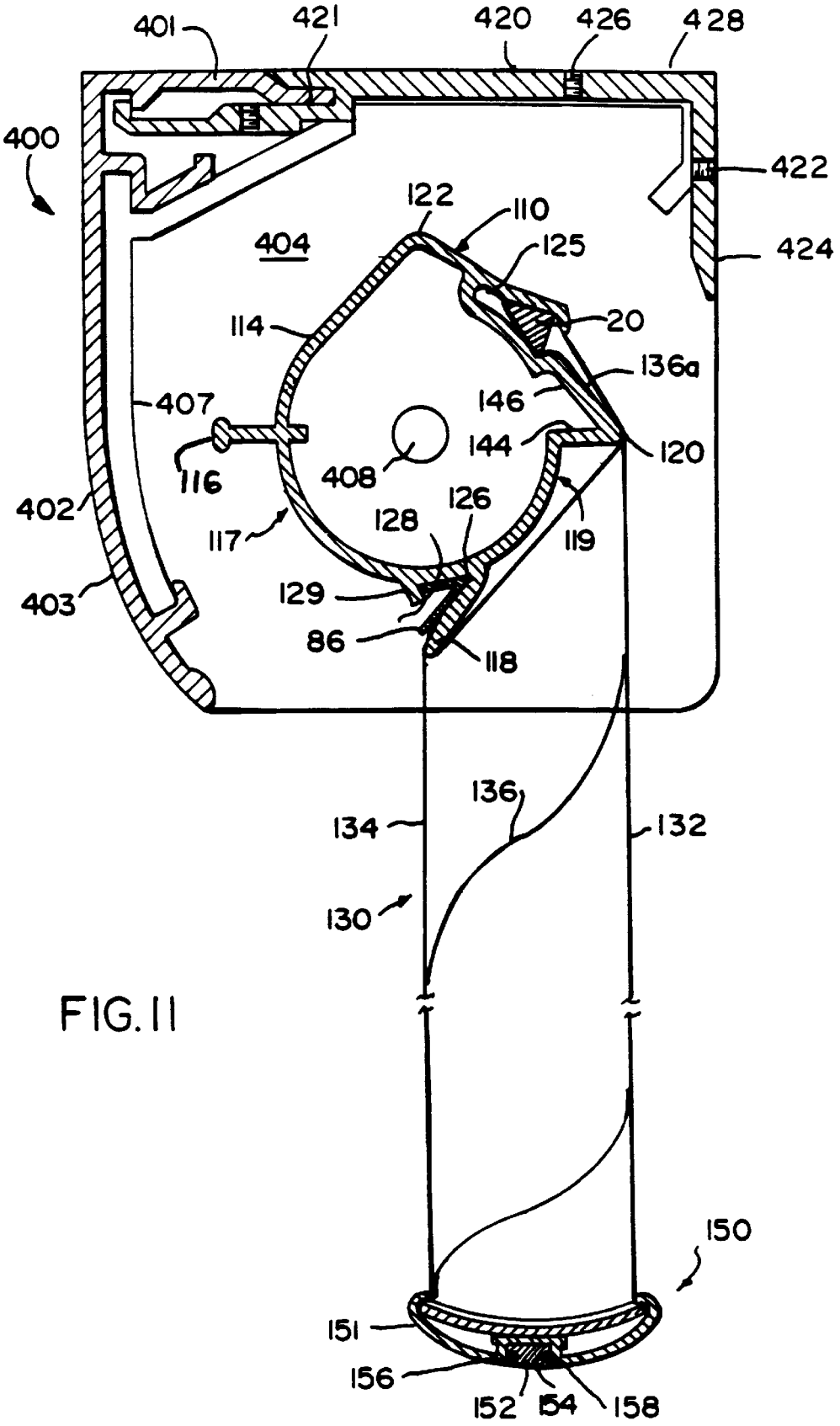
FIG. 11 is a cross-sectional view of the window covering of FIG. 10, taken along line 11—11 of FIG. 10.

Another preferred embodiment of the present invention, including a valance 400, mounting brackets 420, top-catch mechanism 320, head roller assembly 110, window covering 130 and bottom rail assembly 150, is shown in FIGS. 10 and 11. FIG. 10 is a top view showing valance 400, mounting brackets 420 and the top-catch mechanism 350 of the present invention. The valance 400 may be fabricated as a single, unitary structure; however, in the embodiment shown in FIGS. 10 and 11, the valance 400 comprises three separate parts: a front rail 402 and two opposed end caps 404, 406. Front rail 402 and end caps 404, 406 are provided with complementary ribs and grooves to enable end caps 404, 406 to be removably snap fit onto the opposed ends of front rail 402. Referring now to FIG. 11, the rib 407 of end cap 404 is received in groove 403 of front rail 402 to join the front rail 402 to end cap 404. As seen in FIG. 11, the end cap 404 has a cylindrical projection 408 provided on the inner surface thereof for mounting the head roller assembly 110 of window covering 130 in the valance 400. Similarly, end cap 406 is provided with a cylindrical projection (not shown) for rotatably mounting the head roller assembly 110 of the window covering 130 in the valance 400.

Two mounting brackets 420 are provided to mount the valance 400 against a wall or against a ceiling to cover a window. Each mounting bracket 420 is provided with a groove 422, for securely receiving the upper edge 401 of the front rail 402 of the valance 400, as shown in FIG. 11. Each mounting bracket 420 can be provided with additional features, such as ribs, grooves and the like which are complementary to the rib and groove structure of the inner surface of the front rail 402, to provide additional points of engagement and support between the mounting brackets 420 and the valance 400.

An important advantage of using mounting brackets 420 is that the mounting brackets 420 need not be precisely located on the wall or ceiling so as to support the very ends of the valance 400 or the head roller assembly 110. In contrast to conventional mounting means for roller type window coverings, there is considerable latitude for the relative placement of mounting brackets 420 on a wall or ceiling. Provided that the mounting brackets 420 are spaced apart sufficiently to adequately support the valance 400 in proper alignment, the exact spacing between mounting brackets 420 are conveniently secured to a wall by screws, molly bolts or the like inserted into a wall through hole 42 in the downwardly extending leg 424 of the mounting bracket 420 or into a ceiling through holes 424 in the upper leg 428 of the mounting bracket 420.

The other main components of this embodiment are head roller assembly 110, light control window covering 130 and bottom rail assembly 150, which are shown in detail in FIG. 11. Head roller assembly 110 includes a rigid central support member 114 provided with a number of lobes or rounded projections 116, 118, 120, and 122. Recess 117 is formed between lobes 116 and 118, and recess 119 is formed between lobes 118 and 120. In the embodiment of FIG. 11, in contrast to the embodiment of FIG. 5, each of the lobes or rounded projections 116, 118, 120, and 122 has a different structural configuration. Lobe 116 is similar in structure to lobe 16 of the head roller assembly 10 of FIG. 5. Lobe 118 extends outwardly from the longitudinal axis of the rigid support 114. However, lobe 118 is an angled projection and does not extend radially outwardly from support member 114 as does lobe 116.

Lobe or rounded projection 118 also forms one leg of a V-shaped channel 126. The opposite, shorter leg 128 of V-shaped channel 126 is formed along the outer surface of support member 114. The shorter leg 128 of the V-shaped channel 126 terminates in stop 129, which projects outwardly from the surface of the support member 114 and inwardly into V-shaped channel 126. The V-shaped channel 126 of the head roller assembly 110 cooperates with the V-strip 86 shown in FIG. 9*a* to secure the second sheer fabric 134 to the head roller assembly 110, in the manner described above with reference to FIGS. 9*a* and 9*b*.

Head roller assembly 110 also includes a wedge shaped channel 125, similar in configuration to wedge shaped channel 22 of the head roller assembly 10 shown in FIG. 5. The wedge shaped channel 125 is configured to be complementary to the wedge shaped filler strip 20, shown in FIG.

5. As discussed with reference to FIG. 5, the wedge shaped filler strip 20 in combination with the wedge shaped channel 125 of the head roller assembly 110 provides attachment means for securing the window covering 130 to the head roller assembly 110 and ensuring proper alignment of the first and second sheer fabrics 132, 134 and the vanes 136 with respect to the head roller.

Lobe 120 is provided along support member 114, adjacent the end of the wedge shaped channel 125 formed along the outer surface of the support member 114. Lobe 120 extends outwardly from the longitudinal axis of the support member 114. However, instead of a straight radially outwardly extending projection like lobe 116, lobe 120 is formed by two legs 144, 146. Leg 144 of lobe 120 extends substantially radially outwardly with respect to the longitudinal axis of the support member 114. Leg 146 of the lobe 120 slopes downwardly from the distal end of leg 144 to a location along the support member 114 adjacent the end of the wedge shaped channel 125. When the window covering 130 is secured to the head roller assembly 110 using a wedge shaped filler strip 20 inserted in wedge shaped channel 125, the top vane 136*a* is supported against the sloping leg 146 of the lobe 120.

In the embodiment shown in FIG. 11, lobe 122 extends radially outwardly from the longitudinal axis of the support member 114, and is formed by an eccentric portion of the support member 114, rather than a separate outward projection from the circumferential surface of the support member 114 like projections or lobes 116, 118, and 120. It is not required that the lobe 122 have this particular shape. Lobe 122 may extend radically outwardly a distance less than lobes 116, 118, and/or 120, as shown in FIG. 11; however, this difference in radical extension is not essential. Similarly, in other embodiments of the head roller assembly of the invention, the distances which the lobes or projections extend from the support member, relative to one another, are not critical.

In the embodiment shown in FIG. 11, the front and rear bottom rails are combined into a single bottom rail assembly 150. The bottom rail assembly 150 includes a single, extruded bottom rail structure 151, preferably of extruded aluminum, having a substantially C-shaped cross section. A longitudinally extending weight receiving channel 152 is provided in the bottom or bottom rail 151. A weight 154 is slidably received in the weight receiving channel 152 and is retained therein by retaining lips 156, 158 of the bottom rail 151. The position of weight 154 within weight receiving channel 152 can be adjusted as necessary to counteract any skewing of the window covering 130 as it rolls up around the head roller, as described with respect to the embodiment shown in FIG. 3.

Figure 12A:
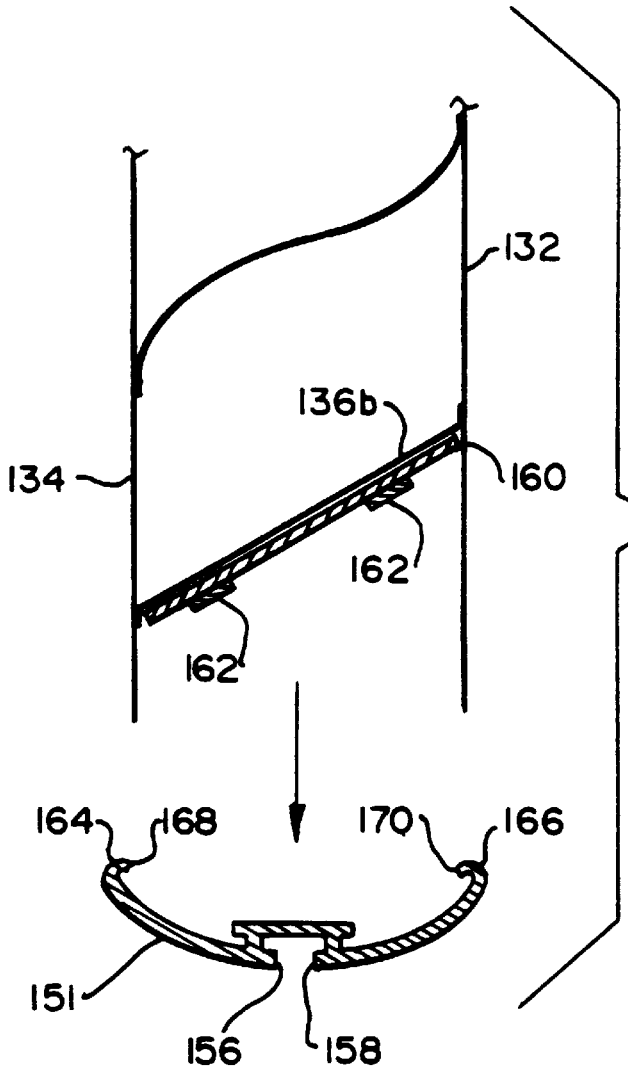
FIGS. 12*a*, 12*b* and 12*c* are partial cross-sectional views of an alternative bottom rail assembly according to the present invention.
Figure 12B:
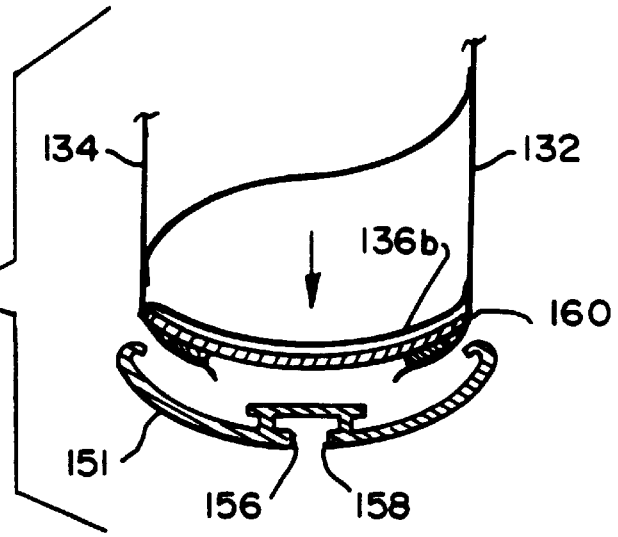
Figure 12C:
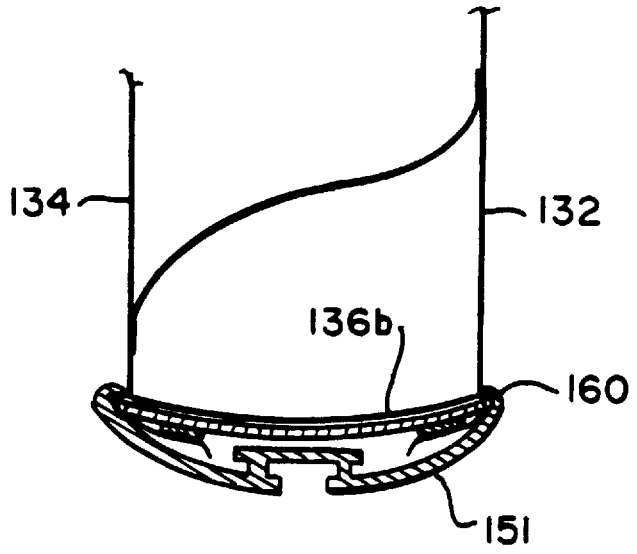

The bottom portion of the window covering 130 is secured to the bottom rail assembly 150 simply and easily as shown in FIGS. 12*a* and 12*b*. A thin slat 160 of stiff and resilient material, such as aluminum or a suitable plastic material, is placed against the downwardly facing side of the lowermost vane 136*b*. The ends of first fabric 132 and second fabric 134 are at least temporarily secured to the underside of the thin slat 160 by transfer tape 162. The thin slat 160 with the ends of fabrics 132 and 134 secured thereto is then press or snap fit into the bottom rail 151 by exerting a bending force on the thin slat 160. The width of thin slat 160 is greater than the distance between the surfaces 168, 170 or curved edges 164, 166, respectively of the bottom rail 151. The thin slat 160, because of its resiliency, is bent or curved to fit under curved edges 164, 166 and upon releasing the bending force on the slat 160, curved edges 164, 166 of the bottom rail 151 retain the thin slat 160, curved edges 164, 166 of the bottom rail 151 retain the thin slat 160 in the bottom rail 151 and securely hold the ends of the fabrics 132 and 134 inside the bottom rail assembly 150. Preferably, the thin slat 160 is bend or curved about 30° for snap-in and curves back or loses part of its curve after having been snapped in. In one embodiment of the invention, the thin slat 160 remains curved at about 20° after having been snapped in. The fact that the thin slat remains curved after snapping it into the bottom rail makes the width of the slat far less critical. The amount of the curvature is not critical.

The curved or C-shaped structure of bottom rail assembly 150 is important for several reasons. First, the curved shape allows the bottom rail assembly to roll up behind the rolled up fabric of the window covering in a minimum amount of space (see FIG. 14*a*). Further, the curved structure of the bottom rail imparts a curve to the snap in slat, by applying tension to the ends of the slat. The outward force exerted by the curve of the slat against the curved edges of the bottom rail holds the fabric tightly at these points. Finally, the curve in the slat also makes up for the distance differences between the front and rear fabrics caused by the extent of travel of the respective fabrics around the ends of the slat and, more importantly, the ends of the slat exert an outward pressure at the inside edges 166, 164 of the bottom rail 151.

Figure 13:
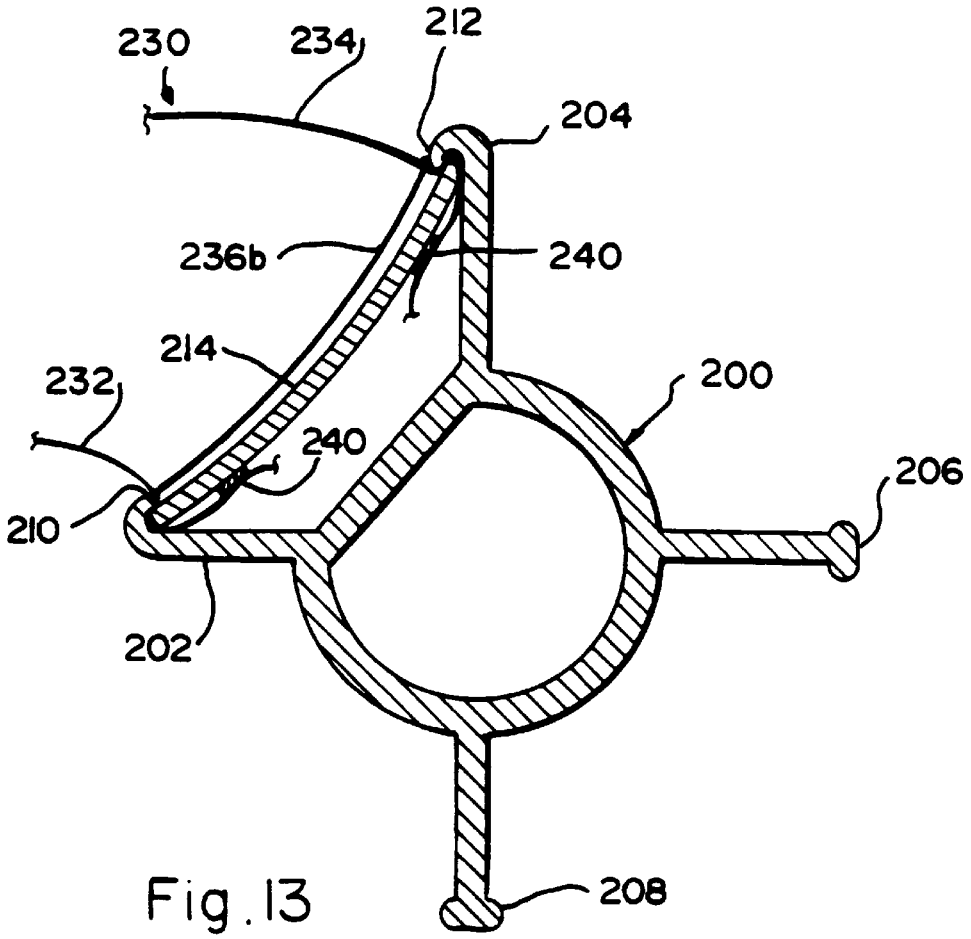
FIG. 13 is a cross-sectional view of another embodiment of a head roller according to the present invention.

In another embodiment, shown in FIG. 13, two adjacent lobes or projections 202, 204 of the head roller 200 are provided with curved, retaining edges 210, 212, respectively. Remaining lobes 206, 208 may be of any suitable configuration, such as rounded projections as shown in FIG. 13. the lobes 202, 204 cooperate with a thin slat 214 of a stiff, springy material to secure the top ends of the first fabric 232 and the second fabric 234 of the window covering 230 to the head roller 200. The top ends of the first and second fabrics 232, 234 are secured to the head roller 200 in the same way the bottom ends of the first and second fabrics 132, 134 are secured to the bottom rail assembly 150 in the embodiment of FIG. 11, as shown in FIGS. 12*a* and 12*b*. That is, one surface of the thin slat 214 is held against the upper surface of uppermost vane 236*a* and then the ends of the first fabric 232 and the second fabric 234 are at least temporarily secured to the other surface of the thin slat 214 by transfer tape 240. Then, the thin slat 214, with the window covering 230 at least temporarily secured thereto is press or snap fit between the lobes 202, 204 of the head roller 200 by exerting a bending force on the thin slat 214. When the bending force is released, the thin slat 214 straightens out somewhat and is retained in place on the head roller 200 by the curved retaining edges 210, 212 of the lobes 202, 204, respectively, thereby securing the window covering 230 to the head roller 200. As shown in FIG. 13, the thin slat 214 preferably remains curved after it has been snapped into the head roller 200, so that the slat 214 exerts an outward pressure force against the inner portions of the retaining edges 210, 212 of the lobes 202, 204, respectively. Further, the curved slat provides an accommodation space for the window covering when it is rolled up. The degree of curvature of the slat 214 is not critical and the slat may be substantially straight after being snapped into the head roller.

A fabric light control window covering deployed such as in the present invention is operated by first unrolling the window covering and then continuing to rotate the head roller in order to articulate the vanes. However, if the head roller is rotated in the unroll direction beyond a certain point the window covering will begin to roll up in the wrong direction. This will cause the vanes to bend back on themselves and possibly form creases in the vanes which could create an uneven appearance or impair the operation of the window covering. Also, with the vanes bent back over themselves the window covering will be extremely bulky when rolled up and may not fit into the space allotted for the head roller. Thus, the present invention provides a flip-catch mechanism 60 (FIG. 3), for preventing wrong-way roll up of the window covering. it will readily be appreciated by those skilled in the art that the flip-catch mechanism is useful for roller shades of all types in which it is desired to prevent wrong-way roll up.

Flip-catch mechanism 60 includes arm 62 which is secured to the head roller by hinged attachment 64. Also provided is a cooperating stop 66 which may be included as part of an associates valence 65. Arm 62 is movable between a first position engaging stop 66 and a second position, indicated in dotted lines at 62*a*, resting in one of the recesses 18 between lobes 16.

Figure 4A:
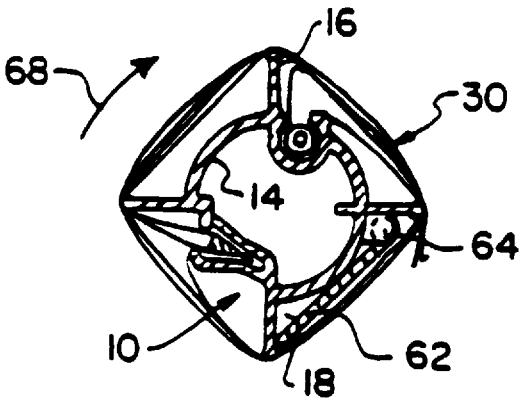
FIGS. 4*a–c* are cross-sectional views of a head roller and flip-catch mechanism according to the present invention, sequentially illustrating the operation of the flip-catch mechanism.
Figure 4B:
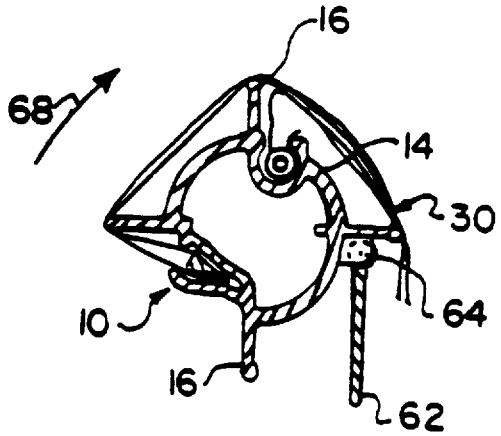
Figure 4C:
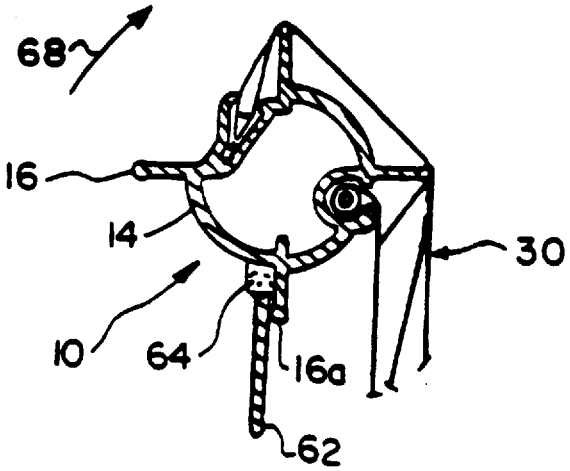

The operation of flip-catch device 60 is illustrated in FIGS. 4*a–c*. Beginning with FIG. 4*a*, arm 62 is in the second position resting in recess 18 with window covering 30 wrapped around head roller assembly 10. Window covering 30 is unrolled by rotating the head roller assembly 10 in the direction indicated by arrow 68. Arm 62 is retained in the second position by window covering 30 being wrapped around head roller assembly 10 as the window covering is unrolled. As shown in FIG. 4*b*, once the window covering has been unrolled to the point where it no longer extends completely around head roller assembly 10, arm 62 moves from the second position, between the lobes, due to the force of gravity as it is rotated around the bottom of head roller assembly 10. Further rotation of head roller assembly 10, in the direction of arrow 68, causes arm 62 to engage lobe 16*a* as shown in FIG. 4*c*. Still further rotation of head roller assembly 10 in the same direction brings arm 62 into contact with stop 66 and thus prevents further rotation of head roller assembly 10 in that direction, as shown in FIG. 3. When the window covering is rolled up, rotation of the head roller assembly 10 in the opposite direction of arrow 68 automatically causes arm 62 to move back into the second position inside window covering 30 and resting between lobes 16.

Figure 7A:
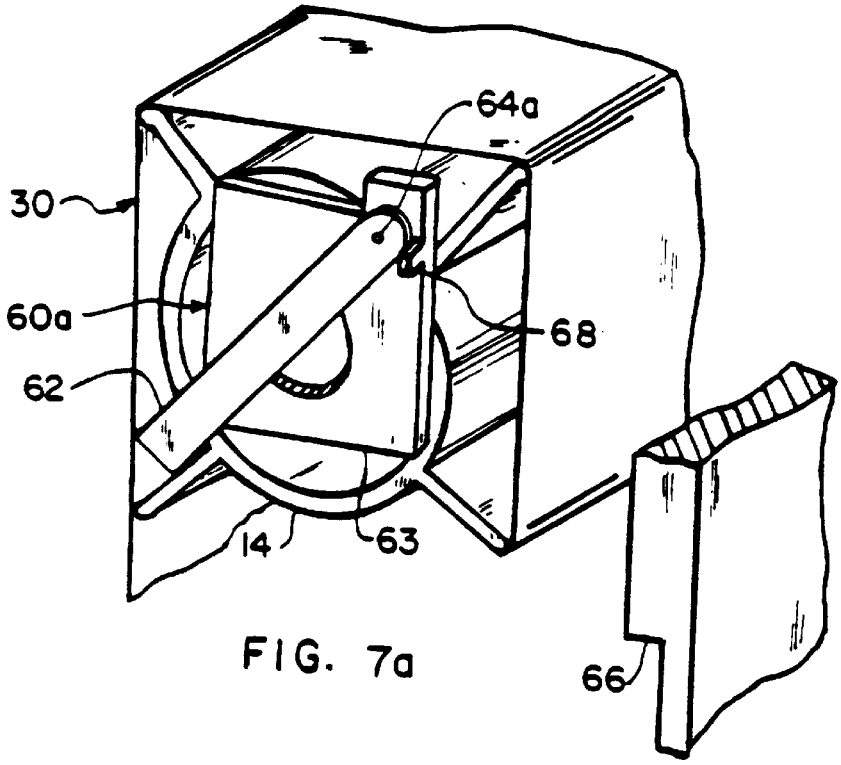
FIGS. 7*a–b* are perspective end views of a roller and roller end cap provided with a flip-catch device according to a preferred embodiment of the invention.
Figure 7B:
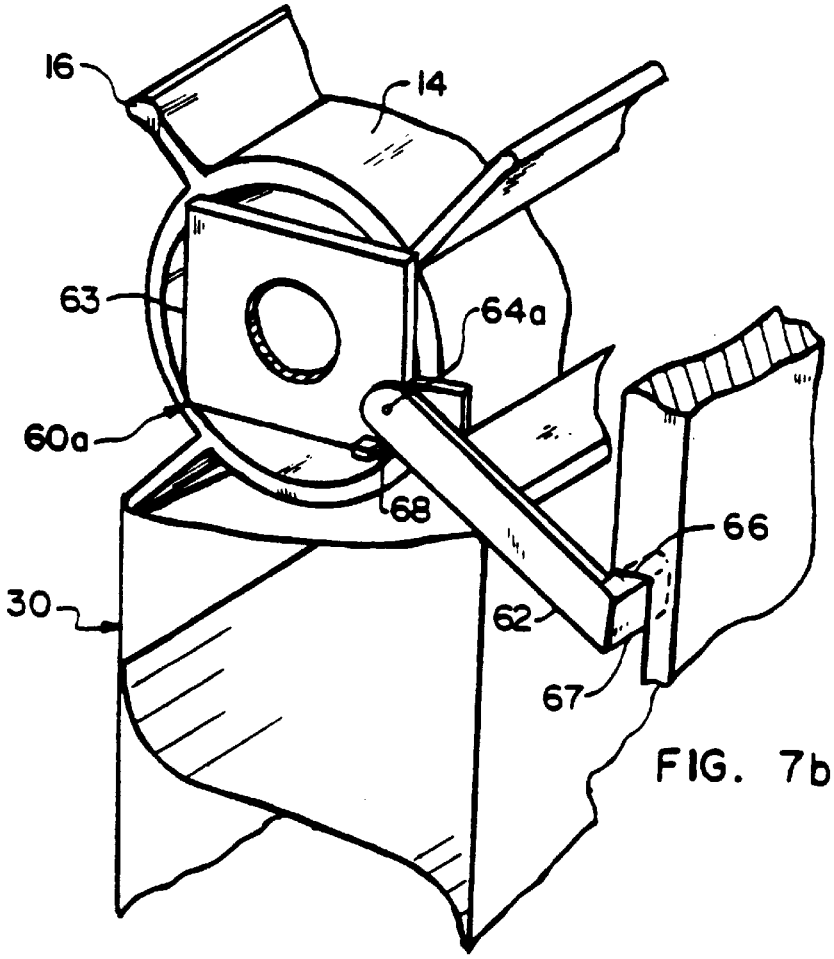

In a preferred embodiment, the flip-catch mechanism may be provided as an end cap 60*a*, shown in FIGS. 7*a–b*. FIG. 7*a* illustrates the second position and FIG. 7*b* the first position referred to above. Arm 62 is provided on base 63 with pivotable connection 64*a*. Base 63 is shaped to be inserted into support member 14 and engage support member 14 without relative rotation. In this arrangement arm 62 is disposed beyond the end of support member 14, therefore inwardly directed tab 67 is provided at the end of arm 62*a* to catch on window covering 30 and cause arm 62 to be moved from the second to the first position when the window covering is rolled up. The attachment means for the window covering 30 are not shown in FIGS. 7*a–b* in order to clearly illustrate the flip-catch mechanism. Stop tab 68 extends from base 63 to limit the travel of arm 62 in the first position, engaging stop 66. In this embodiment arm 62*a* may be longer because it does not have to fit between lobes 16.

The present invention further provides an alternative top-catch mechanism 350 (FIGS. 10, 14*a* and 14*b*) for preventing wrong way roll up and down of the window covering. Top-catch mechanism 350 also prevents jamming of the head roller assembly which can be caused by rotating the head roller too far in the proper roll up direction, thereby causing the bottom rail assembly or assemblies to rotate around the head roller and become jammed between the valance and the head roller. It will be readily appreciated by those skilled in the art that the top-catch mechanism is useful for roller shades of all types in which it is desired to prevent wrong-way roll up and/or over rotation of the head roller in the proper roll up direction. Top-catch mechanism 350 and flip-catch device 60 provide alternative means to prevent wrong way roll up of a window covering.

Figure 14C:
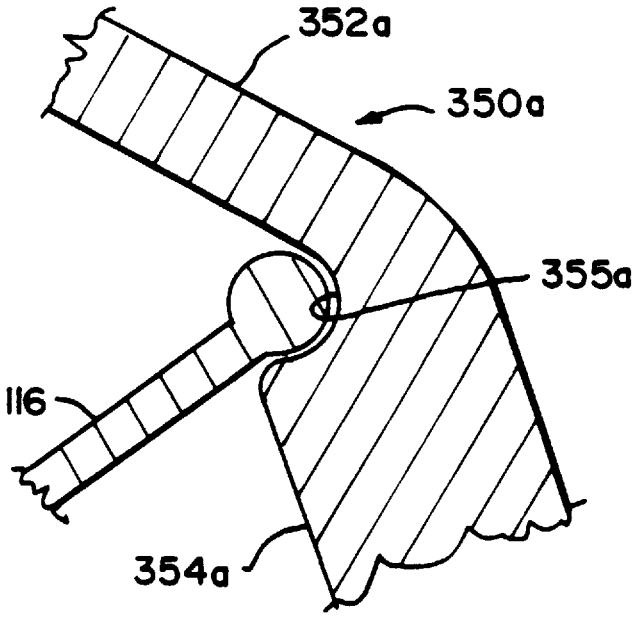
FIG. 14*c* is an enlarged cross-sectional view of a portion of an alternate embodiment of the top-catch mechanism according to the present invention.
Figure 14A:
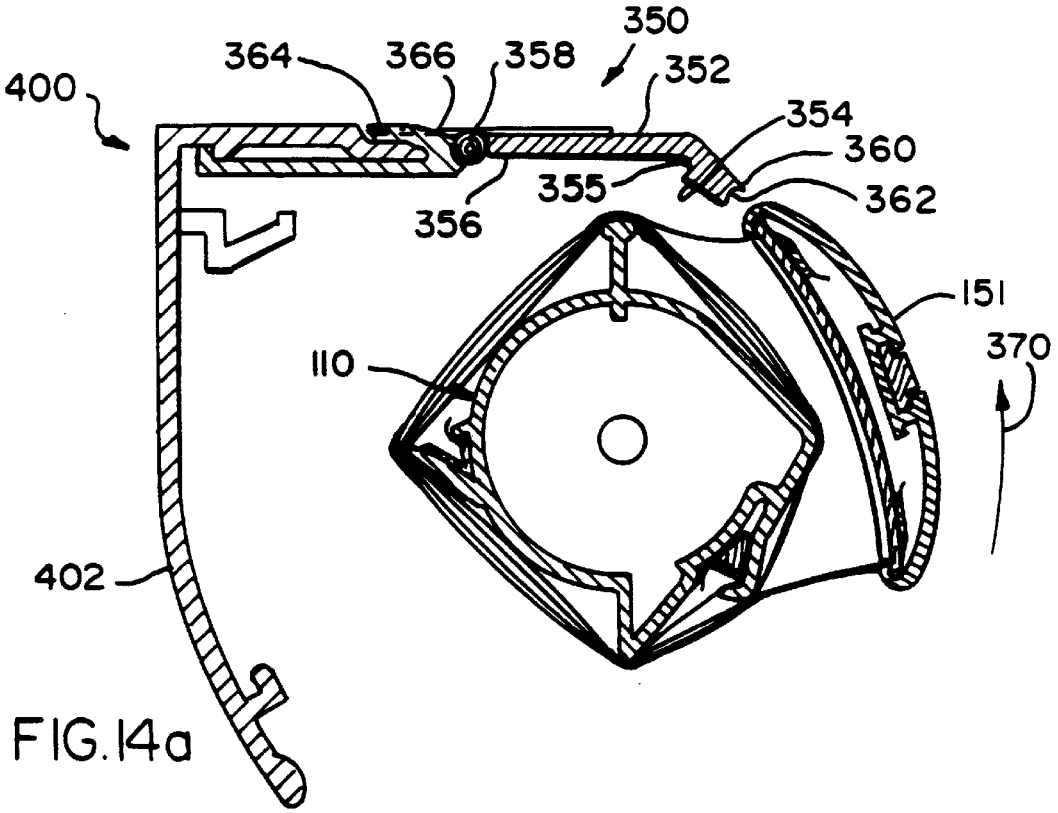
FIGS. 14*a* and 14*b* are cross-sectional views of a head roller and top-catch mechanism according to the present invention, illustrating the operation of the top-catch mechanism.
Figure 14B:
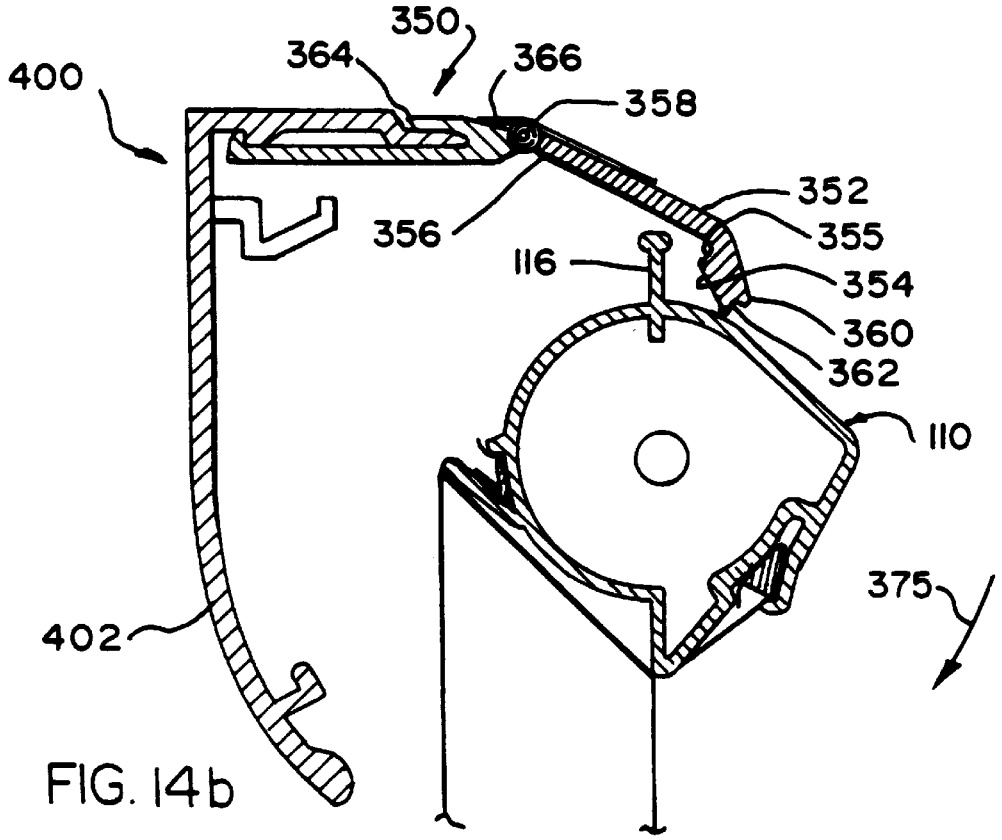

As shown in FIGS. 14*a* and 14*b*, top-catch mechanism 350 includes a swing arm 352 having a downwardly extending terminal portion 354. The end 356 of the swing arm 352 opposite the terminal portion 354 is pivotally mounted such that swing arm 352 pivots around pivot point 358 and such that swing arm 352 and connecting arm 364 are hinged freely relative to one another. Preferably, the edge 360 of the terminal portion 354 has a curved channel 362 formed therein. In the embodiment shown in FIGS. 14*a* and 14*b*, the top-catch mechanism 350 is carried by the valance 400 and is connected to the valance 400 by connecting arm 364.

The top-catch mechanism 350 also includes spring means 366 which exerts a light downward spring force against the swing arm 352 and thus biases the swing arm 352 toward the head roller 110.

The operation of top-catch mechanism 350 is illustrated in FIGS. 14*a–b*. Beginning with FIG. 14*a*, the window covering 140 is in the completely rolled up state and further rotation of the head roller 110 in the roll up direction, indicated by arrow 370, is prevented by the top-catch mechanism 350. As seen in FIG. 14*a*, the downward spring force exerted by spring means 366 biases the lower surface of the terminal portion 354 of the swing arm 352 toward the rolled up fabric of the window covering 130. The edge of the bottom rail 151 abuts against the edge 360 of the terminal portion 354 of the swing arm 352, preventing further rotation of the head roller 110. Preferably, as shown in FIG. 14*a*, the channel 362 formed in the terminal portion 354 of the swing arm 352 and the outer edge of the bottom rail 151 are complementarily shaped so that the bottom rail 151 abuts securely against the terminal portion of the swing arm 352 and the channel 362 positively grabs the outer ends of the bottom rail 151 without sliding off and without scratching or marring of any decorative finish on the bottom rail.

Window covering 130 is unrolled by rotating the head roller assembly 110 in the direction indicated by arrow 375. The downward spring force applied to swing arm 352 by spring means 366 is light enough that as the window covering 130 is unrolled, the lower surface of the terminal portion 354 passes along the surface of the outermost layer of rolled fabric. The pivot point permits the swing arm to move up and down as required by the irregular configuration of the outer surface of the rolled fabric. As shown in FIG. 14*b*, after the window covering 130 has been completely unrolled, the shoulder 355 of the terminal portion 354 of the swing arm 352 contacts the lobe 116 of the head roller assembly 110, preventing further rotation of the head roller 110 in the wrong roll up direction. FIG. 14*c* is an enlarged view of a portion of an alternative embodiment of the top-catch mechanism 350*a*, showing the end of the lobe 116 contacting the shoulder 355*a* of the termination portion 354*a* of the swing arm 352*a*. In this embodiment, the shoulder 355*a* of the top-catch mechanism 350*a* has a shape complementary to that of the end of the lobe 116.

Figure 15:
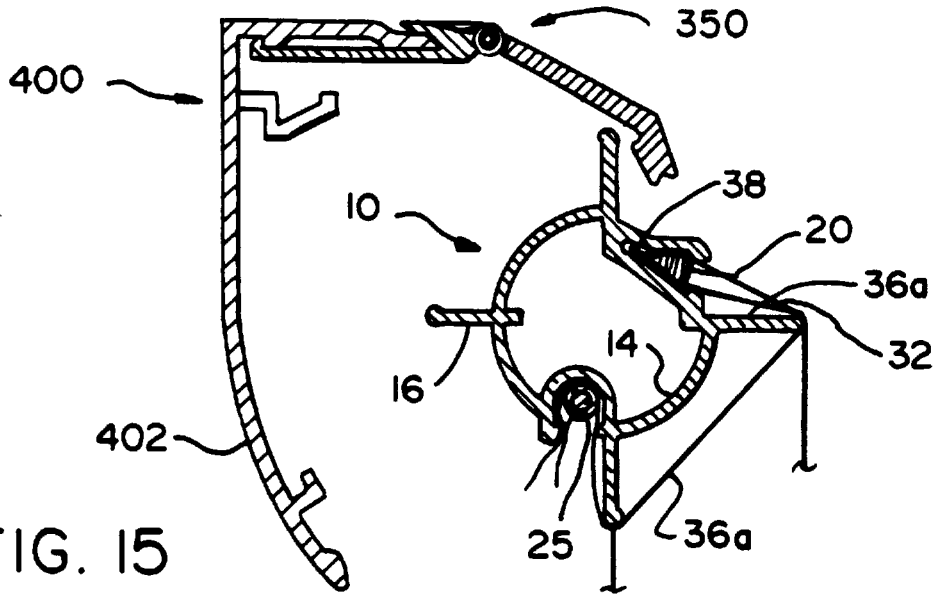
FIG. 15 is a cross-sectional view of another embodiment of a head roller and top-catch mechanism according to the present invention.
Figure 16:
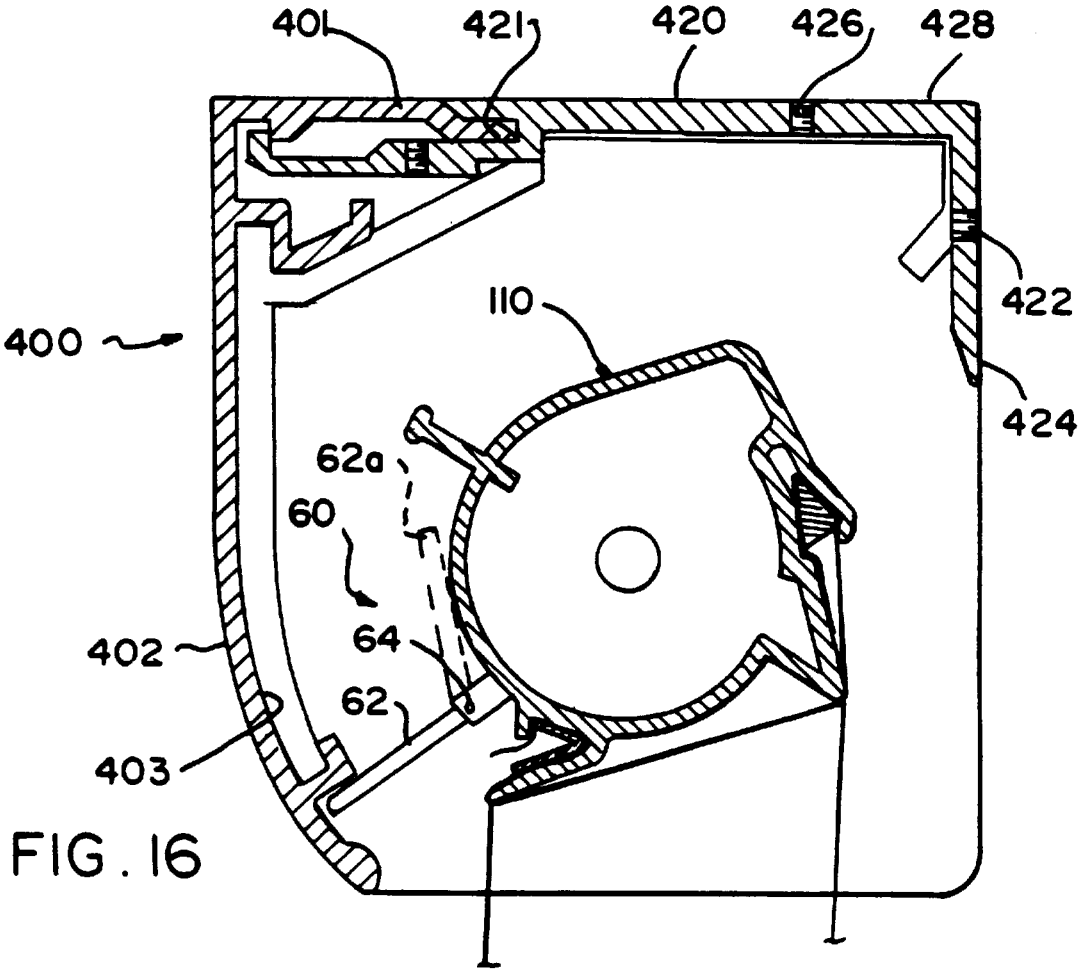
FIG. 16 is a cross-sectional view of another embodiment of a head roller and flip-catch mechanism according to the present invention.

As shown in FIGS. 15 and 16, respectively, the top-catch mechanism 350 can be used in conjunction with head roller 10 and valance 400, and flip-catch mechanism 60 can be used together with head roller 110 and valance 400 to prevent wrong way roll up. Although various embodiments and aspects of the present invention have been described, including specific combinations of head rollers, bottom rails, valances and means for preventing wrong way roll up of window coverings, it is to be understood that the individual components of the inventive mounting apparatus may be combined in any desired combination, not just the exemplary combinations specifically described above.

The description of the preferred embodiments contained herein is intended in no way to limit the scop of the invention. As will be apparent to a person skilled in the art, modifications and adaptations of the structure and method of the above-described invention will become readily apparent without departure from the spirit and scope of the invention, the scope of which is described in the appended claims.

What is claimed is:

1. The combination of a flexible hanging panel and bottom rail therefor comprising a hanging panel embodying first and second parallel sheets of material, an elongated bottom rail defining a longitudinally extending channel therein, and an elongated insert frictionally engaged in said channel holding inserted edges of said panel in said channel.

2. A panel and bottom rail as defined in claim 1, further comprising opposed longitudinal inwardly directed projections on said bottom rail extending into said channel whereby said channel is C-shaped in cross section, and said resilient elongated strip is coextensively retained in said channel by said longitudinal inward projections, said elongated strip engaging behind said longitudinal inward projections and exerting pressure thereon for securing said sheets in said channel.

3. A panel and bottom rail as defined in claim 2, wherein said retained resilient elongated strip is transversely curved.

4. The combination of a flexible hanging panel and bottom rail therefor, comprising a hanging panel formed by first and second parallel flexible fabric sheets of material, an elongated bottom rail defining a longitudinally extending channel having a flattened C-shaped cross section with opposed longitudinal inward projections, and a resilient elongated strip inserted in and extending along said longitudinal channel and being retained in said channel by engagement thereof with said longitudinal inward projections, said elongated strip securing the bottom edge portions of said sheets in said channel with the bottom edge portion of the first sheet wrapped around one longitudinal edge of said elongated strip and the bottom edge portion of the second sheet wrapped around the other longitudinal edge of said elongated strip.

5. A panel and bottom rail as defined in claim 4, wherein said inserted elongated strip is transversely curved.

6. A retractable covering device comprising a panel having first and second parallel flexible fabric sheets and a plurality of spaced apart adjustable transverse vanes secured between said sheets along lines of attachment, a roller rotatable about a longitudinal axis for rolling and unrolling said panel, said roller defining a discontinuous surface forming recessed areas for receiving buckles of said sheets and vanes for preventing creation of wrinkles therein, said roller defining a longitudinally extending recess for receiving the line of attachment between the first sheet and a vane, and means for holding said sheet in said recess along said line of attachment.

7. The covering device as defined in claim 6, wherein said roller includes a surface which is discontinuous to provide areas to receive buckles of said sheets and vanes which result from rolling up said light control element.

8. A retractable covering device comprising a panel having spaced juxtaposed first and second parallel flexible sheets and a plurality of spaced apart transverse vanes secured between said sheets along lines of attachment, a roller rotatable about a longitudinal axis and defining an axially extending recess in the surface thereof for receiving a line of attachment between said first sheet and a vane, and a securing strip frictionally engaged in said recess and holding said sheet therein along said line of attachment.

9. A covering device as defined in claim 8, wherein said roller defines an outer surface having a plurality of longitudinal recesses therein for receiving said sheets and vanes when said panel is rolled on said roller.

10. A retractable window covering comprising:

a light control panel comprising:

spaced juxtaposed parallel first and second flexible sheets, and a plurality of spaced apart parallel transverse vanes carried between and connecting said sheets, wherein said plurality of transverse vanes are attached to said sheets along attachment lines and a roller secured to said sheets along an attachment line and rotatable about a longitudinal axis for rolling and unrolling said light control panel, said roller defining an outer surface having peripherally wide recessed areas therein adapted to nonsupportingly receive buckles of said sheets and vanes which result from rolling up said light control panel, and a plurality of ribs extending outwardly from said roller and defining apexes at their outer ends spaced from the outer surface of said roller, said apexes defining longitudinal contact points for said panel when wrapped around said roller, said apexes being circumferentially spaced apart so as to provide a substantially straight path for said light control panel from one apex to an adjacent apex.

11. A retractable window covering as defined in claim 10, wherein said apexes are spaced apart such that each substantially straight path from one apex to an adjacent apex has a length of at least one-half inch.

12. A retractable window covering as defined in claim 10, wherein said roller defines a longitudinal channel having a V-shaped cross-section and an inward projection extending over one leg of the V-shaped channel, and said light control panel further comprises a resilient V-shaped strip inserted into said V-shaped channel with one of said sheets wrapped at least partially therearound and with one leg of the V-shaped strip engaged behind said projection to retain said strip and said one sheet securely in said channel.

13. A retractable window covering as defined in claim 10, wherein said roller defines a longitudinal channel having a circular cross-section with a longitudinal opening having a width less than the diameter of the channel, and said light control panel further comprises, a resilient tubular member compressibly inserted through said opening into said channel with one of said sheets wrapped at least partially therearound and thereby retained in said channel by said tubular member.

14. A retractable window covering as defined in claim 10, wherein said roller defines a longitudinally extending channel generally triangular in cross-section opening into the outer surface of said roller, said triangular channel having an outwardly directed longitudinal opening along its base with inturned outer edges and a longitudinally extending vertex opposite said opening, a longitudinally extending recess parallel to the roller axis opening into said vertex for receiving the line of attachment between the first sheet and a vane, and a longitudinally extending channel circumferentially spaced from said triangular channel and having a V-shaped cross-section with an inwardly extending projection, said light control panel further comprising:

an elongated wedge-shaped member forcing said line of attachment between said vane and said first sheet into said vertex recess of said triangular channel to ensure parallel alignment of said vanes with said roller and holding the same in said triangular recess, and a resilient V-shaped strip inserted in said V-shaped channel with said second sheet wrapped partially therearound and with one leg engaged behind said projection to retain said V-shaped strip and second sheet in said V-shaped channel.

15. A retractable window covering as defined in claim 10, wherein said roller defines a longitudinally extending channel generally triangular in cross-section opening into the outer surface of said roller, said triangular channel having an outwardly directed longitudinal opening along its base with inturned outer edges and a longitudinally extending vertex opposite said opening, a recess parallel to the roller axis opening into said vertex for receiving the line of attachment between the first sheet and a vane, and a longitudinally extending channel circumferentially spaced from said triangular channel and having a circular cross-section with a longitudinal opening having a width of less than the diameter of the channel, said light control panel further comprising:

an elongated wedge-shaped member forcing said line of attachment between said vane and said first sheet into said vertex recess of said triangular channel to ensure parallel alignment of said vanes with said roller and holding the same in said triangular recess, and a resilient tubular member compressibly inserted through said opening into said circular channel with said second sheet wrapped partially therearound thereby to retain said second sheet securely engaged with said roller.

16. A retractable window covering as defined in claim 15, further comprising:

an elongated member attached along bottom edge portions of both said first and second sheets, said elongated member defining a channel of substantially C-shaped cross-section with opposed longitudinal inward projections, and a resilient elongated strip, each longitudinal edge of said elongated strip engaging behind one of said longitudinal inward projections on said elongated member and said elongated strip exerting pressure thereon for securing said light control panel in said elongated member when said elongated strip is inserted in said elongated member, whereby the bottom edges of the first and second sheets are wrapped around respective longitudinal edges of said elongated strip and said elongated strip is inserted in said C-shaped channel to attach said elongated member to said light control panel.

17. A retractable window covering as defined in claim 10, further comprising an arm with two ends, a first end operably connected to said roller and a second end biased towards said recessed areas of said roller, and wherein said light control panel is only rolled up by said roller in a single direction of rotation.

18. A retractable covering device comprising first and second spaced, parallel, vertical sheets with bottom edges, a plurality of transverse vanes attached between and connecting said sheets along attachment lines, a first elongated member having a longitudinal axes and defining a longitudinally extending channel, a cooperating retainer member inserted in said channel, the bottom edge of at least one of said first and second sheets inserted in said channel and retained therein along an attachment line by engagement therewith of said inserted retainer member, a second elongated member having a longitudinal axis and defining a longitudinally extending second channel, and a cooperating second retainer member inserted in said second channel, the bottom edge of the other of said sheets being inserted in said second channel and retained therein along an attachment line by engagement therewith of said inserted second retainer member.

19. A retractable covering device comprising first and second spaced, parallel, vertical sheets with bottom edges, a plurality of transverse vanes attached between and connecting said sheets along attachment lines, a first elongated member having a longitudinal axis and defining a longitudinally extending channel, and a cooperating retainer member inserted in said channel, the bottom edge of at least one of said first and second sheets inserted in said channel and retained therein along an attachment line by engagement therewith of said inserted retainer member, characterized in that said channel is triangular in cross-section defining an outwardly directed longitudinal opening along its base and a longitudinally extending recessed vertex opposite said opening, said retainer member being wedge-shaped in cross-section whereby said retainer member forces said line of attachment between said vane and said sheet into said vertex recess to ensure parallel alignment of said vanes with said bottom rail.

20. A retractable covering device comprising first and second spaced, parallel, vertical sheets with bottom edges, a plurality of transverse vanes attached between and connecting said sheets along attachment lines, a first elongated member having a longitudinal axis and defining a longitudinally extending channel, and a cooperating retainer member inserted in said channel, the bottom edge of at least one of said first and second sheets inserted in said channel and retained therein along an attachment line by engagement therewith of said inserted retainer member, characterized in that said channel is V-shaped in cross-section and defines an inwardly projecting longitudinally extending lip, and said retainer member is a resilient V-shaped strip, one leg of which engages behind said projection when said retainer member is inserted in said V-shaped channel.

21. A retractable covering device comprising first and second spaced, parallel, vertical sheets with bottom edges, a plurality of transverse vanes attached between and connecting said sheets along attachment lines, a first elongated member having a longitudinal axis and defining a longitudinally extending channel, and a cooperating retainer member inserted in said channel, the bottom edge of at least one of said first and second sheets being inserted in said channel and retained therein along an attachment line by engagement therewith of said inserted retainer member, characterized in that said channel is circular in cross-section and defining an opening of a width less than the inside diameter of said channel, and said retainer member is a resilient tubular clamping member clampingly engaging an inserted edge of one of said sheets in said channel.

22. A retractable covering device comprising first and second spaced, parallel, vertical sheets with bottom edges, a plurality of transverse vanes attached between and connecting said sheets along attachment lines, a first elongated member having a longitudinal axis and defining a longitudinally extending channel, and a cooperating retainer member inserted in said channel, the bottom edge of at least one of said first and second sheets inserted in said channel and retained therein along an attachment line by engagement therewith of said inserted retainer member, a second elongated member having a longitudinal axis and defining a longitudinally extending second channel, and a cooperating second retainer member inserted in said second channel, the bottom edge of the other of said sheets inserted in said second channel and retained therein along an attachment line by engagement therewith of said inserted second retainer member, characterized in that said channel of said first elongated member is triangular in cross-section defining an outwardly directed longitudinal opening along its base and a longitudinally extending recessed vertex opposite said opening, said retainer member of said first elongated member being wedge-shaped in cross-section whereby said retainer member forces said line of attachment between said vane and said sheet into said vertex recess to ensure parallel alignment of said vanes with said bottom rail, said channel of said second elongated member is V-shaped in cross-section and defines an inwardly projecting longitudinally extending lip and said retainer member of said second elongated member is a resilient V-shaped strip, one leg of which engages behind said projection when said retainer member is inserted in said V-shaped channel.

23. A retractable covering device comprising first and second spaced, parallel, vertical sheets with bottom edges, a plurality of transverse vanes attached between and connecting said sheets along attachment lines, a first elongated member having a longitudinal axis and defining a longitudinally extending channel, a cooperating retainer member inserted in said channel, the bottom edge of at least one of said first and second sheets inserted in said channel and retained therein along an attachment line by engagement therewith of said inserted retainer member, a second elongated member having a longitudinal axis and defining a longitudinally extending second channel, and a cooperating second retainer member inserted in said second channel, the bottom edge of the other of said sheets being inserted in said second channel and retained therein along an attachment line by engagement therewith of said inserted second retainer member, characterized in that said channel of said first elongated member is triangular in cross-section defining an outwardly directed longitudinal opening along its base and a longitudinally extending recessed vertex opposite said opening, said retainer member of said first elongated member being wedge-shaped in cross-section whereby said retainer member forces said line of attachment between said vane and said sheet into said vertex recess to ensure parallel alignment of said vanes with said bottom rail, said channel of said second elongated member is circular in cross-section and defines an opening of a width less than the inside diameter of said channel, said second retainer member is a resilient tubular clamping member clampingly engaging an inserted edge of the other of said sheets in said channel.

24. A retractable covering device comprising a light control element having first and second spaced, parallel, vertical sheets with bottom edges and a plurality of transverse vanes attached between and connecting said sheets along attachment lines, a first elongated member having a longitudinal axis and defining a longitudinally extending channel, and a cooperating retainer member inserted in said channel, the bottom edge of at least one of said first and second sheets inserted in said channel and retained therein along an attachment line by engagement therewith of said inserted retainer member, characterized in that said channel is substantially C-shaped in cross-section and defines opposed inwardly projecting longitudinally extending lips, said retainer member comprising a resilient elongated strip having opposed longitudinal edges, each longitudinal edge of said elongated strip engaging behind one of said longitudinal lips securing said light control element in said elongated member.

25. A retractable covering device comprising a light control element having first and second spaced, parallel, vertical sheets with bottom edges and a plurality of transverse vanes attached between and connecting said sheets along attachment lines, a first elongated member having a longitudinal axis and defining a longitudinally extending channel, and a cooperating retainer member inserted in said channel, the bottom edge of at least one of said first and second sheets inserted in said channel and retained therein along an attachment line by engagement therewith of said inserted retainer member, characterized in that said channel is substantially C-shaped in cross-section and defines opposed inwardly projecting longitudinally extending lips, said retainer member comprising a resilient elongated strip having opposed longitudinal edges, each longitudinal edge of said elongated strip engaging behind one of said longitudinal lips securing said light control element in said elongated member.

* * * * *